US006236149B1

(12) United States Patent
Rolfson

(10) Patent No.: US 6,236,149 B1
(45) Date of Patent: May 22, 2001

(54) FIELD EMISSION DEVICES AND METHODS OF FORMING FIELD EMISSION DEVICES HAVING REDUCED CAPACITANCE

(75) Inventor: J. Brett Rolfson, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/126,939

(22) Filed: Jul. 30, 1998

(51) Int. Cl.[7] ..... H01J 1/304; H01J 19/24
(52) U.S. Cl. ..... 313/309; 313/336; 445/24
(58) Field of Search ..... 445/24; 313/309, 313/311, 292, 296, 351, 336, 422, 495, 496, 497

(56) References Cited

U.S. PATENT DOCUMENTS 5,404,070 * 4/1995 Tsai et al. ..... 313/309
5,548,185 * 8/1996 Kummar et al. ..... 313/495
5,561,343 * 10/1996 Lowe ..... 445/24
5,635,789 * 6/1997 Makishima et al. ..... 313/309
5,658,832 * 8/1997 Bernhardt et al. ..... 445/24
5,695,378 * 12/1997 Hecker, Jr. et al. ..... 445/24
5,780,318 * 7/1998 Hirano et al. ..... 313/309
5,866,979 * 2/1999 Cathey, Jr. et al. ..... 313/309
6,008,063 * 12/1999 Derraa ..... 313/309
6,008,576 * 12/1999 Nakatani et al. ..... 313/309

* cited by examiner

*Primary Examiner*—Michael H. Day
*Assistant Examiner*—Santiago
(74) *Attorney, Agent, or Firm*—Wells, St. John, Roberts, Gregory & Matkin, P.S.

(57) ABSTRACT

The present invention includes field emission devices and methods of forming field emission devices. According to one aspect of the invention, a field emission device includes a substrate; at least two adjacent and spaced emitters extending from the substrate; a conductor spaced from the substrate and configured to receive an electrical charge to control the emission of electrons from the at least two adjacent and spaced emitters; and a plurality of spaced insulative conductor supports positioned between the conductor and the substrate, and intermediate the at least two adjacent and spaced emitters.

43 Claims, 7 Drawing Sheets

22

22

FIELD EMISSION DEVICES AND METHODS OF FORMING FIELD EMISSION DEVICES HAVING REDUCED CAPACITANCE

TECHNICAL FIELD

The present invention relates to field emission devices and methods of forming field emission devices.

BACKGROUND OF THE INVENTION

A typical conventional field emission display is designated with reference numeral 10 in FIG. 1. The depicted field emission device 10 comprises a faceplate 11 and an opposing baseplate 12. In some conventional display configurations, faceplate 11 comprises a conductive member 13 having a phosphor coating 14 provided thereover and positioned to face baseplate 12. Member 13 is typically coupled with a positive electrode thereby forming an anode. Phosphor coating 14 is configured to emit light responsive to reception of electrons emitted from baseplate 12.

Baseplate 12 comprises a matrix addressable array of cathode emission structures or emitters 16 (only one emitter 16 is illustrated in FIG. 1). Emitter 16 is formed from a semiconductive substrate 17. A conductive gate 18 is provided spaced from substrate 17. An insulative layer 19 (i.e., silicon dioxide) is typically provided intermediate substrate 17 and conductive gate 18.

Responsive to the application of a voltage potential intermediate substrate 17 and conductor 18, electrons are emitted from emitter 16 towards faceplate 11. In particular, conductive gate 18 is provided at a voltage potential higher than the voltage of substrate 17. Such results in the emission of electrons from a tip of emitter 16. Simultaneously, the positive voltage bias applied to faceplate 11 attracts the emitted electrons toward phosphor coating 14. Light is generated responsive to electrons striking phosphor coating 14.

Unfortunately, it has been observed that a capacitive coupling 20 usually occurs intermediate gate conductor 18 and substrate 17 responsive to the application of a voltage potential therebetween. This resultant capacitance adversely affects the speed of operation of field emitter device 10. Such limits the usefulness of the depicted field emitter device configuration in particular applications, such as high frequency operations.

Therefore, a need exists to provide improved field emission devices which avoid the problems associated with the prior art devices.

SUMMARY OF THE INVENTION

The present invention includes field emission devices and methods of forming field emission devices. In certain embodiments, the present invention provides field emission displays.

According to a first aspect, a field emission device includes a substrate and at least two adjacent and spaced emitters extending from the substrate. A conductor is formed spaced from the substrate and configured to receive an electrical charge to control the emission of electrons from the at least two adjacent and spaced emitters. The field emission device additionally includes a plurality of spaced insulative conductor supports positioned between the conductor and the substrate. Further, the spaced insulative conductor supports are formed intermediate the at least two adjacent and spaced emitters.

The insulative conductor supports define at least three void spaces intermediate the at least two adjacent and spaced emitters according to certain aspects of the invention. Provision of plural void spaces intermediate the conductor and the substrate reduce parasitic capacitances therebetween. A supplemental dielectric layer is formed upon surfaces of the insulative conductor supports, conductor and substrate in the preferred configurations of the present invention.

According to a second aspect of the invention, the conductor and substrate of the field emission device define a volume therebetween and all along the conductor between two adjacent emitters. The volume has a greater quantity of void space than of any non-gaseous mass, such as plural insulative supports. The defined volume includes at least two spaced masses of insulative material according to another aspect of the invention.

According to another aspect of the present invention, a field emission device includes two spaced insulative conductor supports individually having plural wall faces. The supports are positioned intermediate two adjacent emitters such that a straight line between the two adjacent emitters passes through four wall faces of the two spaced insulative supports.

A method according to another aspect of the invention comprises the steps of providing a substrate and providing at least two adjacent emitters electrically coupled with the substrate. The method further includes the steps of forming a conductor over the substrate and outwardly of individual ones of the at least two adjacent emitters. Further, the method includes providing plural insulative conductor supports between the conductor and the substrate, and intermediate the at least two adjacent emitters.

Other aspects of the invention are disclosed herein.

The devices of the present invention can have reduced parasitic capacitances. As such, the devices might be available for use in broader applications compared with prior art structures. Exemplary applications include high-speed or high-frequency applications. The devices of the present invention can provide numerous advantages including increased integration, reduced power consumption, smaller area requirements, increased speed, etc.

BRIEF DESCRIPTION OF THE DRAWINGS

Preferred embodiments of the invention are described below with reference to the following accompanying drawings.

FIG. 17 is a cross-sectional view of a segment illustrating another optional processing step.

FIG. 18 is a cross-sectional view of the segment shown in FIG. 17 at a subsequent processing step.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The embodiments disclosed herein are described with reference to field emission displays. Such devices are configured to output light responsive to the application of a voltage potential intermediate an anode and cathode of the display. However, the present invention may be utilized within field emission displays as well as other field emission devices. Exemplary applications of such other field emission devices include high speed amplification or oscillation applications.

Figure 1:
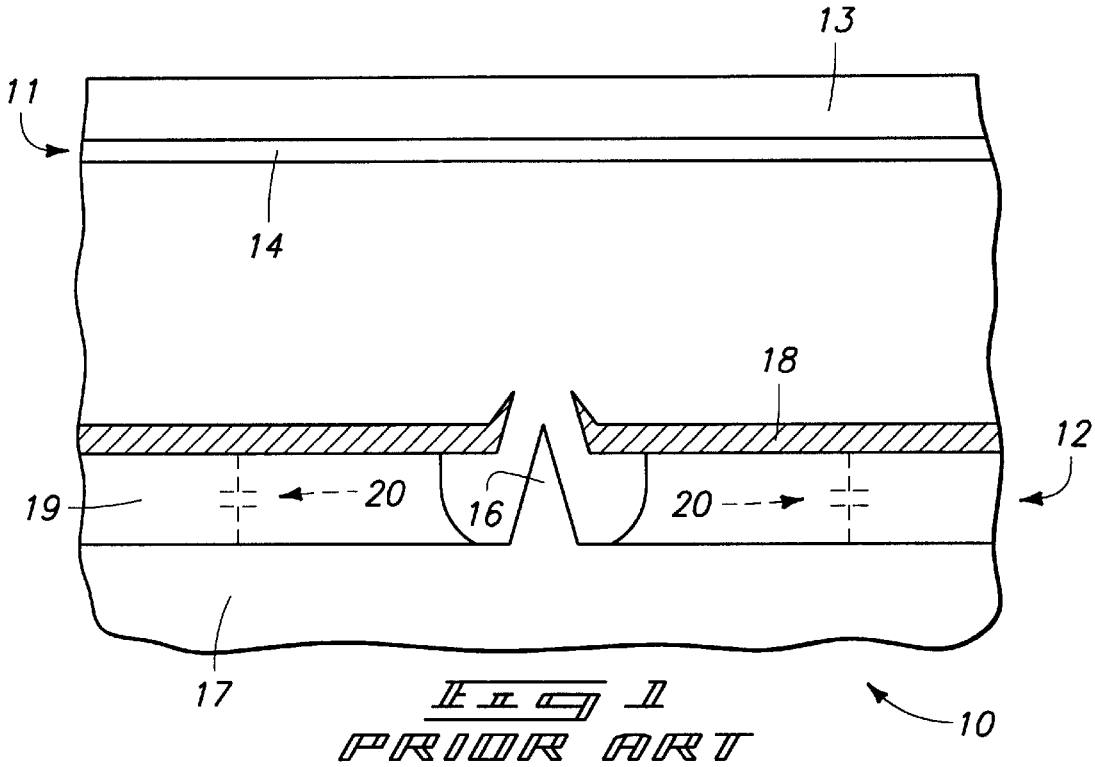
FIG 1 PRIOR ART
FIG. 1 is a cross-sectional view of a segment of a conventional field emission display.
Figure 2:
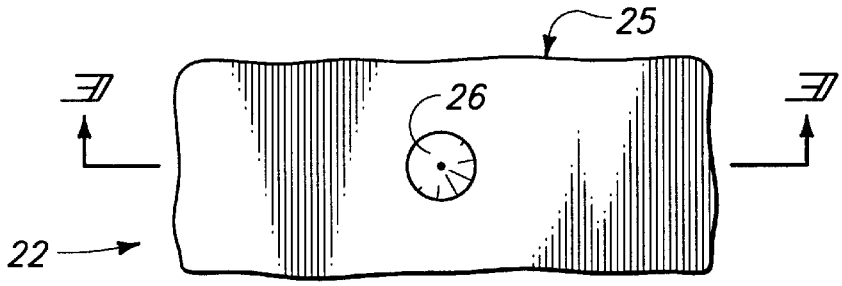
FIG. 2 is a top plan view of a segment of a field emission device according to the present invention at a preliminary processing step.

Referring to FIGS. 2–13, fabrication steps of a field emission device according to a first embodiment are described. A segment or fragment 22 of the field emission device is illustrated in FIG. 2. Segment 22 comprises a bulk substrate 25 initially provided to form the field emission device. Substrate 25 of field emission device segment 22 comprises a semiconductive material, such as silicon. Substrate 25 can alternatively comprise any material from which a field emission device can be fabricated. Substrate 25 can be formed over an insulator such as glass or sapphire (not shown). As described below, selective portions of substrate 25 are preferably doped to provide active areas of increased conductivity.

Field emission devices typically include a plurality of emitters. Only one such emitter 26 is depicted in FIG. 2–FIG. 11 illustrating field emission device segment 22. Typically, field emission devices individually comprise a plurality of pixels and a single pixel comprises a plurality of emitters 26. Emitter 26 may be referred to as a cold cathode field emitter.

Figure 3:
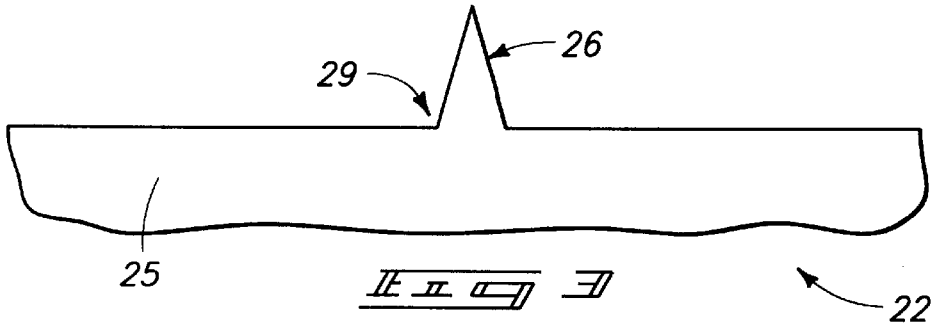
FIG. 3 is a cross-sectional view of the segment of FIG. 2 illustrating an emitter of the field emission device.

Referring to FIG. 3, emitter 26 is formed to extend upwardly from substrate 25. Emitter 26 is formed from substrate 25 and over an emitter region 29 thereof according to one embodiment. An exemplary method of forming emitter 26 includes etching substrate 25 using a pre-formed mask over emitter region 29. An exemplary mask is formed from a hardmask layer. Emitter 26 is electrically coupled with substrate 25 in the described configuration of the field emission device.

Figure 4:
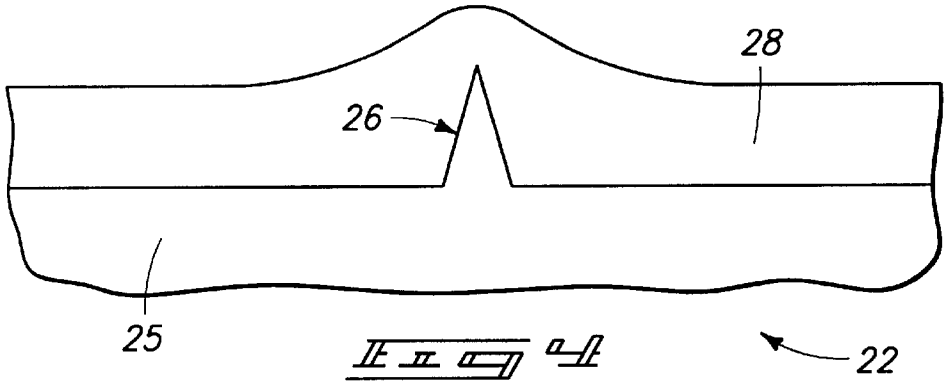
FIG. 4 is a cross-sectional view of the segment shown in FIG. 3 at a subsequent processing step.

Referring to FIG. 4, following fabrication of emitter 26, a layer of first material 28 is formed over substrate 25. In one embodiment, first material 28 comprises an insulative material, such as borophosphosilicate glass (BPSG). An exemplary thickness of first material layer 28 is approximately 1.2 $\mu$m.

Figure 5:
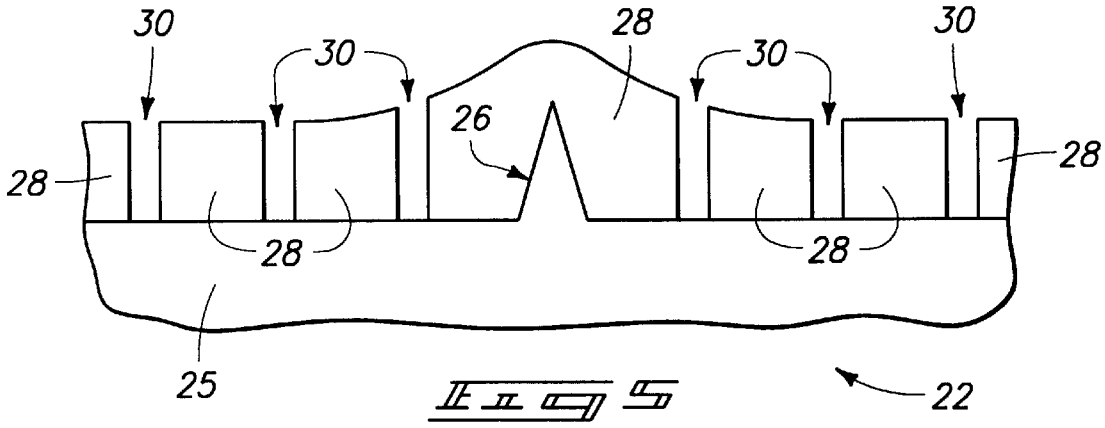
FIG. 5 is a cross-sectional view of the segment shown in FIG. 4 at a subsequent processing step.

Referring to FIG. 5, selected portions of first material or insulative layer 28 are removed to form a plurality of openings 30. Insulative layer 28 is subjected to photopatterning in one embodiment to form openings 30. Such photopatterning provides a plurality of openings 30 within layer 28 which extend through first material layer 28 to substrate 25. An exemplary thickness range of openings 30 is 1.1–1.5 $\mu$m.

One possible fabrication method of openings 30 utilizes an AME 5000™, available from Applied Materials, Inc., at process conditions of 150 mtorr pressure and 900 watts. An exemplary chemistry includes $CF_4$, $CHF_3$, Ar and $N_2$ gases at respective flows of 25, 50, 110 and 30 sccm providing an etch time of approximately 360 seconds for 1.1 $\mu$m of layer 28 comprising BPSG.

As described below with reference to FIG. 8, openings 30 are preferably formed in the shape of enclosed polygons and circles formed about a respective emitter 26. Other shapes for openings 30 are possible (e.g., pillars).

Figure 6:
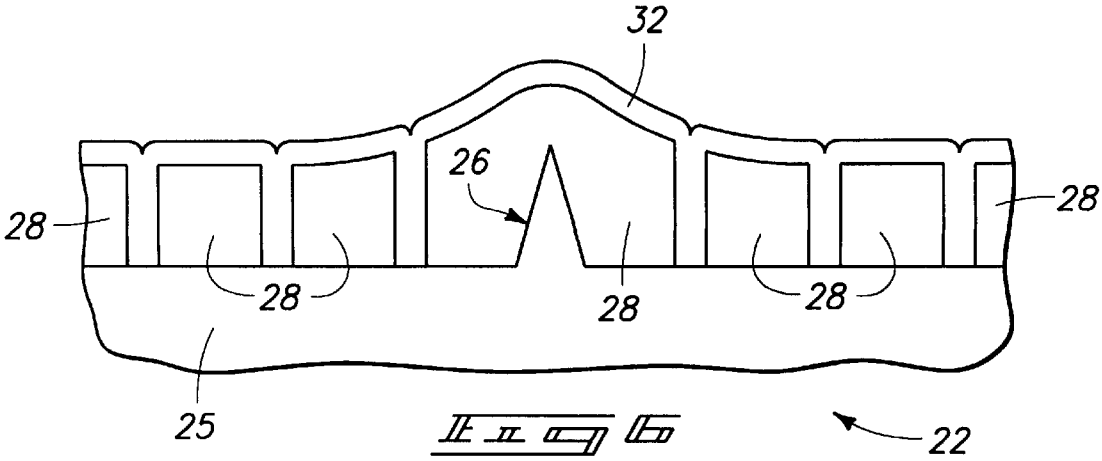
FIG. 6 is a cross-sectional view of the segment shown in FIG. 5 at a subsequent processing step.

Referring to FIG. 6, a second material 32 is provided over first layer 28. Second material 32 is received within openings 30 and forms a second layer over first layer 28 in the illustrated embodiment. Second material 32 comprises an insulative or dielectric material. An exemplary insulative or dielectric material includes silicon nitride ($Si_3N_4$), for example, deposited using low pressure chemical vapor deposition (LPCVD) or plasma enhanced chemical vapor deposition (PECVD). Ideally, second material 32 is preferably selected to permit etching of first material 28 in subsequent processing steps with minimal etching of second material 32 (i.e., selectivity to second material 28).

A Centura™, available from Applied Materials, Inc., is utilized in one embodiment to PECVD deposit second material 32. Second material 32 is deposited at process conditions of 4.2 torr and 700 watts in the described embodiment using a chemistry including $SiH_4$, $N_2$, and $NH_3$ gases at respective flows of 140, 4000 and 60 sccm. Such provides an approximate deposition time of 300 seconds to fill opening 30 having a diameter of 1.5 $\mu$m.

Figure 7:
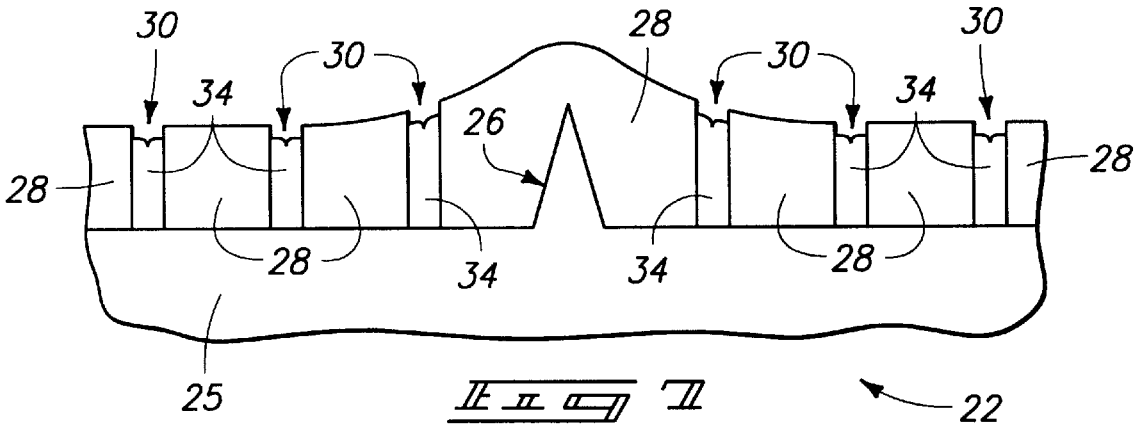
FIG. 7 is a cross-sectional view of the segment shown in FIG. 6 at a subsequent processing step.

Referring to FIG. 7, portions of insulating second material 32 outside or outwardly of openings 30 are removed during processing according to the described embodiment. Such processing leaves a plurality of insulative conductor supports or pillars 34 within openings 30. As described in detail below, supports 34 are configured to support a subsequently formed conductive layer (e.g., conductive gate). Portions of second material layer 32 are removed in a nitride etch in the described embodiment. In particular, a plasma reactive ion etch (RIE) is utilized to remove the second material 34 layered over first layer 28 and outwardly of openings 30.

Figure 8:
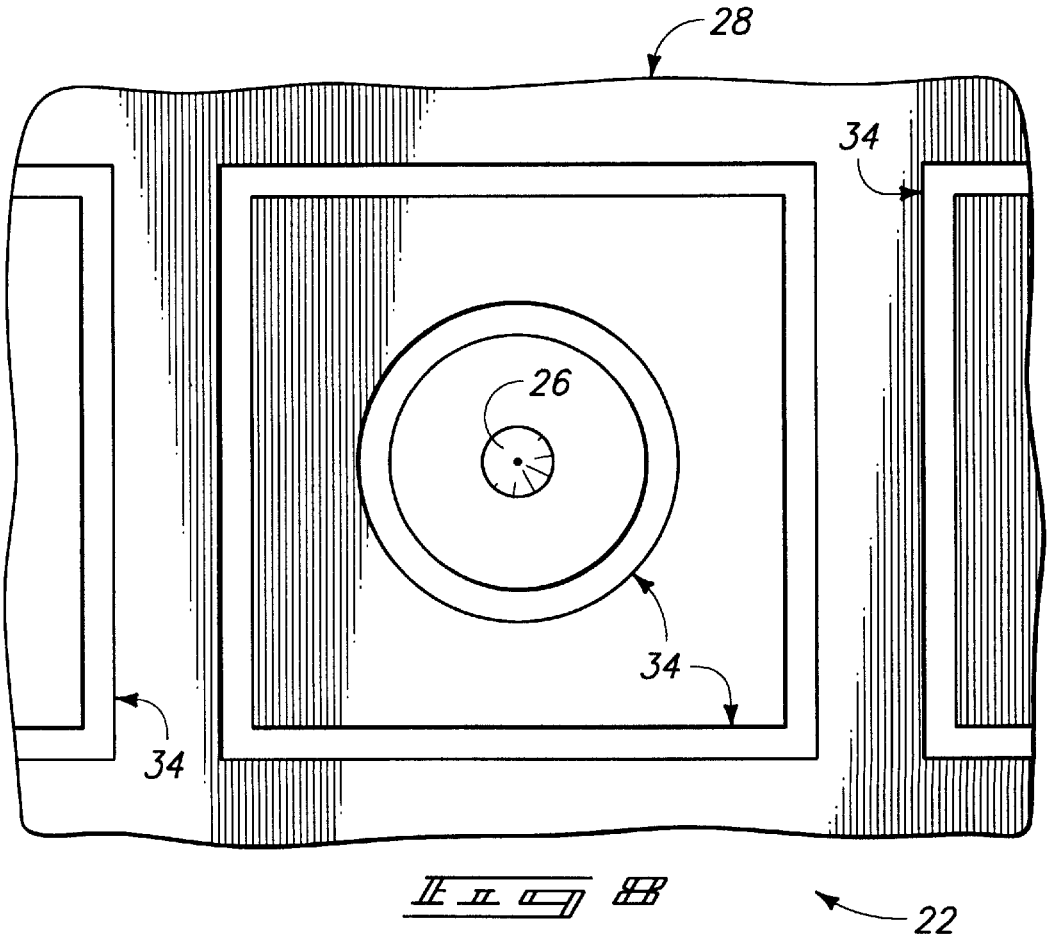
FIG. 8 is a top plan view of the segment shown in FIG. 7.

Referring to FIG. 8, insulative conductor supports 34 comprise polygons and circles in the described embodiment. As illustrated, plural supports 34 can be provided about a single emitter 26. The depicted circular and polygon supports 34 comprise adjacent insulative supports in the described embodiment. Supports 34 are formed as pillars in alternative embodiments.

Figure 9:
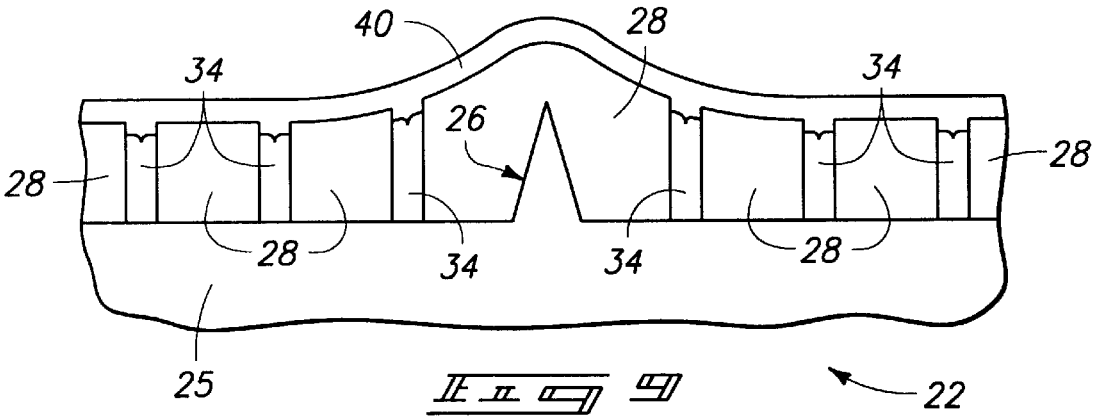
FIG. 9 is a cross-sectional view of the segment shown in FIG. 7 at a subsequent processing step.

Referring to FIG. 9, a conductive layer 40 is formed over first insulative layer 28 and adjacent insulative supports 34. In the described embodiment, conductive layer 40 is formed following removal of portions of second insulative layer 34 outwardly of openings 30 as described previously. Conductive layer 40 comprises a conductive gate (also referred to as a gate electrode) over layer 28 and insulative supports 34.

Conductor 40 is spaced from substrate 25 and is configured to receive an electrical charge to control the emission of electrons from emitters 26. In the described embodiment, conductive layer 40 comprises doped polysilicon or a metal, such as tungsten (W).

Figure 10:
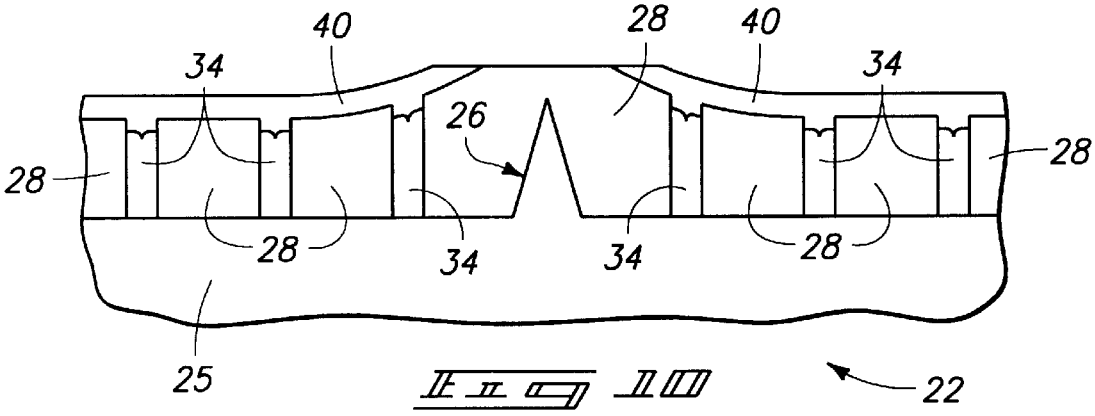
FIG. 10 is a cross-sectional view of the segment shown in FIG. 9 at a subsequent processing step.

Referring to FIG. 10, the field emission device has undergone further processing (i.e., chemical-mechanical polishing) to remove a portion of conductive layer 40 above emitter 26. The removed portion of conductive layer 40 corresponds to emitter 26. Such forms conductive layer 40 outwardly of emitter 26.

Figure 11:
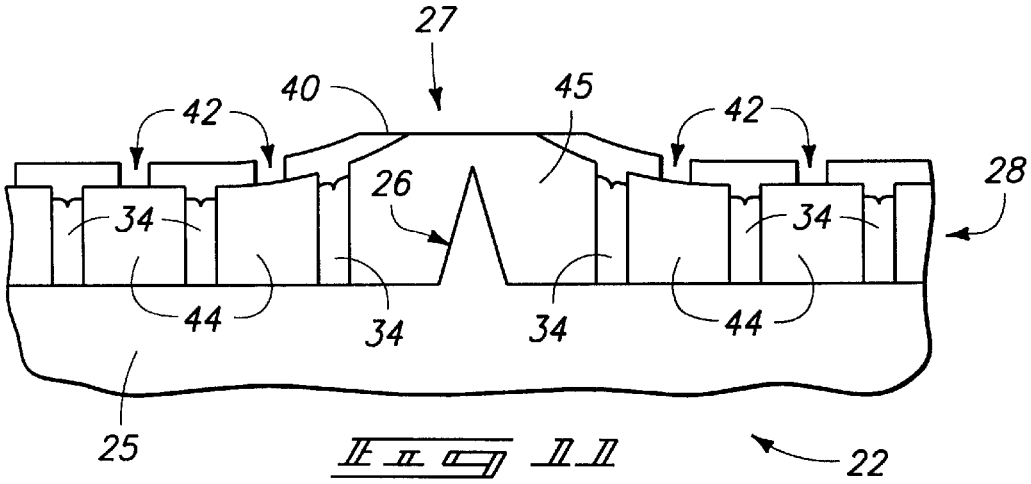
FIG. 11 is a cross-sectional view of the segment shown in FIG. 10 at a subsequent processing step.

Referring to FIG. 11, a plurality of second openings or vias 42 may be formed within conductive layer 40. Second openings 42 expose a plurality of corresponding portions 44 of insulative layer 28 below the positions of respective second openings 42 and intermediate adjacent insulative conductor supports 34. A portion 45 of first material 28 can also be defined within an emitter cavity 27 about emitter 26.

Plural portions 44 are depicted in FIG. 11. Openings 42 can be utilized to provide external access to portions 44 of first layer 28 for etching process steps. Such openings 42 are typically utilized if patterning of conductive layer 40 has not occurred, or conductive layer 40 otherwise covers first layer 28 precluding exposure of portions 44 of layer 28 therebelow.

Figure 12:
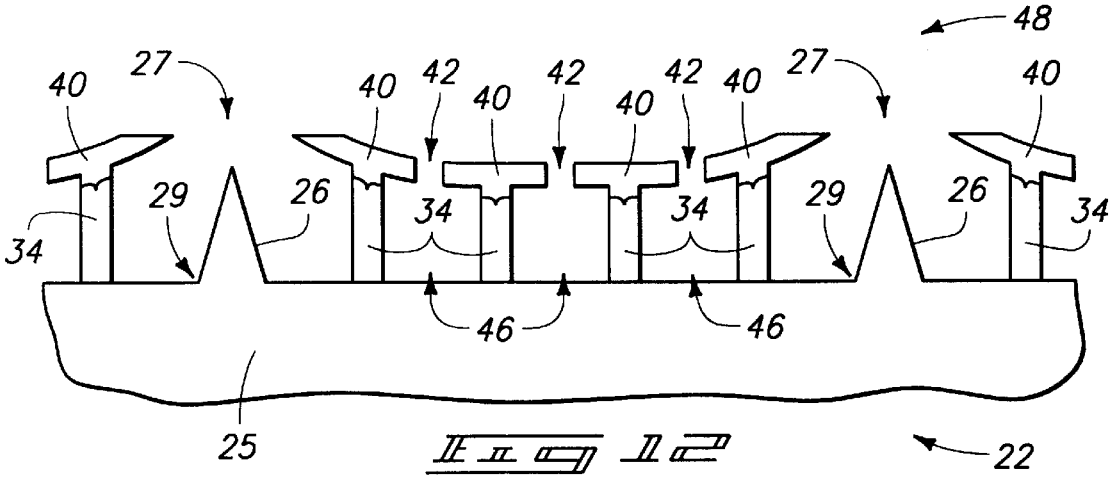
FIG. 12 is a cross-sectional view of a segment having plural emitters at a processing step subsequent to the segment shown in FIG. 11.

Referring to FIG. 12, plural adjacent emitters 26 are illustrated upon substrate 25 in the depicted segment 22. Using openings 42 in accordance with one fabrication method of the present invention, portions 44 of layer 28 are removed to form a plurality of void spaces 46. Void spaces 46 are defined by substrate 25, conductive layer 40 and adjacent insulative supports 34. Removal of portions 44 comprises substantial removal of layer 28 intermediate adjacent emitters 26 in accordance with the preferred embodiment. Provision of such void spaces 46 intermediate substrate 25 and conductor 40 reduces capacitive coupling therebetween.

As illustrated, at least three void spaces 46 are provided intermediate two adjacent emitters 26. In most preferred applications, void spaces 46 comprise vacuum chambers wherein a vacuum is provided within or fills the individual void spaces 46. More specifically, a vacuum is usually provided intermediate the faceplate and baseplate of a field emission device when the faceplate and baseplate are finally sealed relative to one another. Accordingly, the vacuum can also be provided within void spaces 46.

Plural spaced insulative conductor supports 34 are positioned between conductor 40 and substrate 25. Further, spaced insulative conductor supports 34 are formed intermediate the adjacent and spaced emitters 26. Insulative supports 34 support conductor 40 as shown in FIG. 12. As shown in one exemplary embodiment, insulative supports 34 are spaced at substantially equal distances from one another at positions along a straight line intermediate the emitters 26.

In accordance with the described fabrication method, portions 44 of first layer 28 are etched following the formation of conductor 40. Portions 44 are etched using an etchant substantially selective to second material 32. The field emission device is preferably dipped within a wet etch to remove portions 44 of first layer 28. The etchant achieves access to portions 44 of first layer 28 through openings 42. In one exemplary embodiment, the field emission device is dipped within a suitable isotropic wet etch to remove portions 44 of second layer 28. Further, material of first layer 28 within plural emitter cavities 27 about emitters 26 is also removed in the wet etch. A preferred etch solution for BPSG is 7:1 buffered oxide etch (BOE) material and water. An exemplary buffered oxide etch material is $NH_4F$:HF.

Conductor 40 and substrate 25 define a volume 48 therebetween and all along the portion of conductor 40 between the two adjacent emitters 26. In the described embodiment, volume 48 extends between adjacent emitters 26. As shown in FIG. 12, volume 48 has a greater quantity of void space comprising vacuum chambers 46 than of any nongaseous mass, such as insulative supports 34. The void space comprising chambers 46 is provided within a majority portion of volume 48. Such can reduce parasitic capacitances which tend to occur intermediate the anode and cathode of the field emission device during operation. This capacitance reduction can enable use of the device within higher-frequency applications (e.g., high-speed vacuum microelectronic devices).

Defined volume 48 includes at least two spaced masses of insulative material (e.g., insulative conductor supports 34). The spaced masses define at least three separate void spaces 46 and are configured to support conductor 40. Plural masses can be defined by one insulative support.

Figure 13:
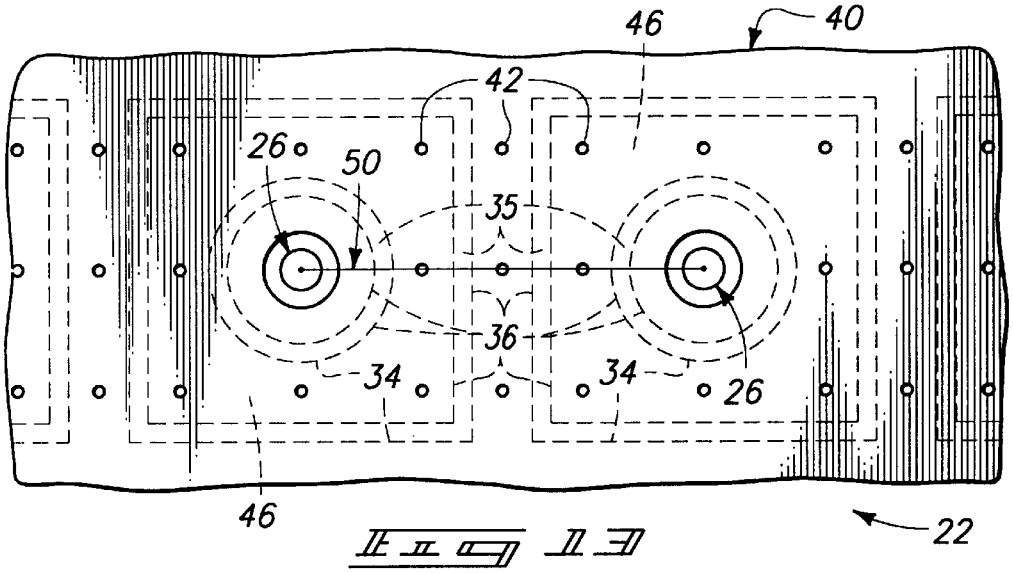
FIG. 13 is a top plan view of the segment of FIG. 12.
Figure 15:
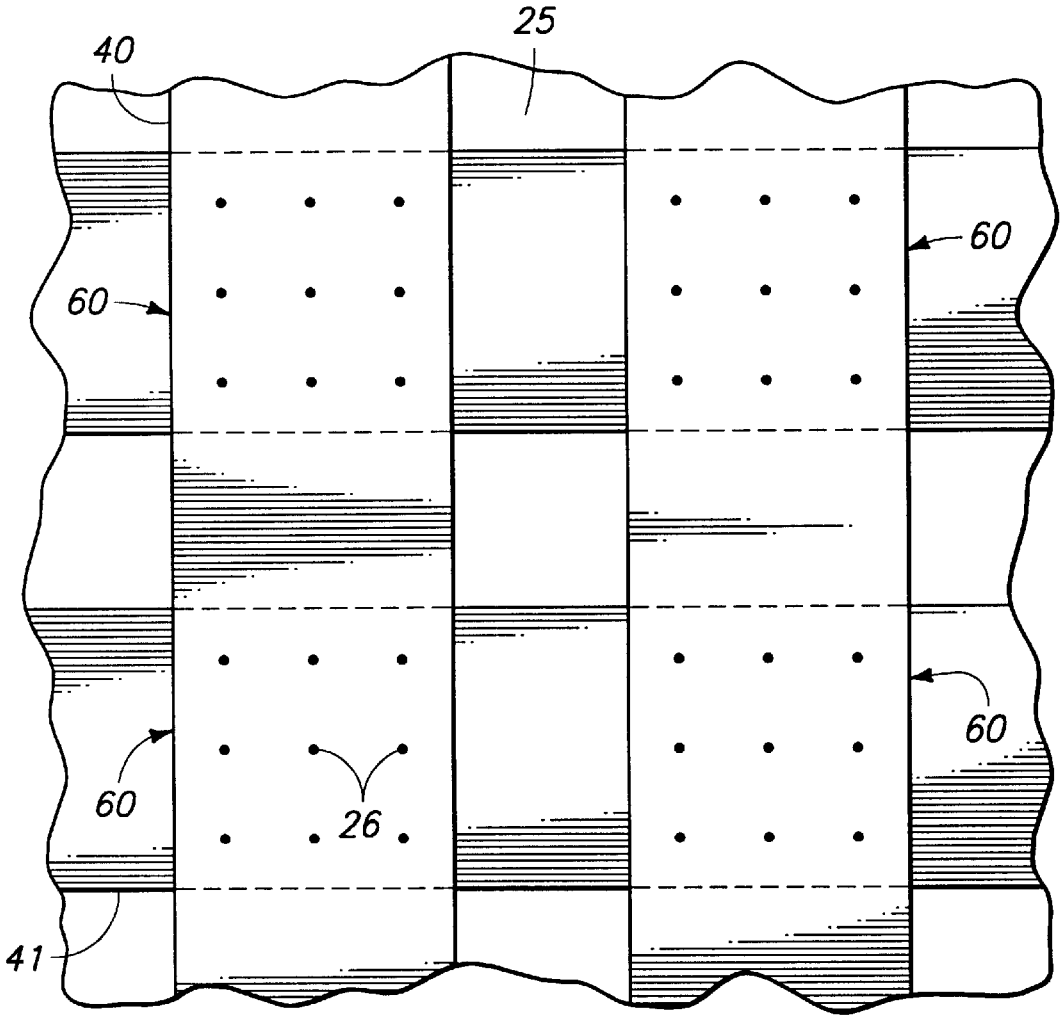
FIG. 15 is a top plan view of a field emission display segment comprising a plurality of emitter tip arrays.

Referring to FIG. 13, a plan view of segment 22 depicted in FIG. 12 is illustrated (the scale of the segment illustrated in FIG. 13 has been reduced compared with the scale of the segment illustrated in FIG. 12). A straight line 50 is shown in FIG. 13. Emitters 26 are formed upon or below straight line 50. In addition, plural spaced masses 35, comprising portions of respective insulative supports 34, are positioned along straight line 50 intermediate spaced emitters 26. With reference to FIG. 15 below, the depicted line 50 is typically one of parallel with or perpendicular to the direction of conductive layer 40 depending upon the particular adjacent emitters 26 being discussed.

As illustrated in FIG. 13, individual portions of insulative conductor supports 34 comprising spaced masses 35 include plural wall faces 36. Straight line 50 intermediate emitters 26 passes through at least four wall faces 36 of at least two insulative conductor supports 34 defining spaced masses 35. In the depicted configuration of segment 22, straight line 50 passes through four spaced insulative masses 35 and eight wall faces 36 thereof.

Openings 42 are formed within conductor layer 40 prior to etching of portions 44 of first layer 28 as described previously. Openings 42 provide access of the wet etch to inner chambers 46 therebelow defined by insulative conductor supports 34. Such permits removal of first layer portions 44 providing void spaces 46. The illustrated number of openings 42 is exemplary and more or less openings can be provided.

Figure 14:
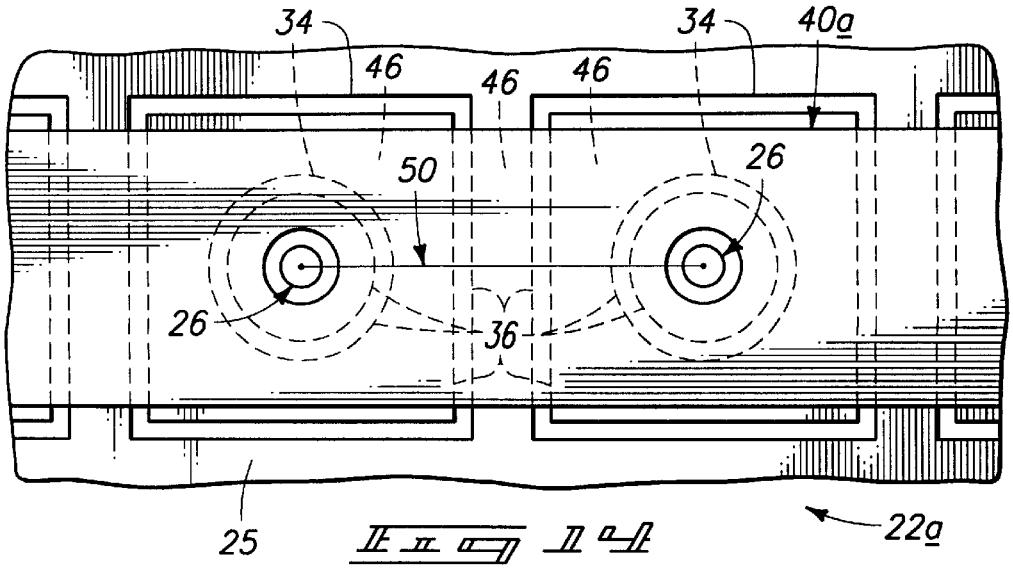
FIG. 14 is a top plan view of a segment of another field emission display configuration.

Referring to FIG. 14, another segment **22*a* corresponding to an alternative field emission device configuration is illustrated. Segment 22*a* includes a patterned conductive layer 40*a*. Conductive layer 40*a* formed over emitters 26 is patterned providing access to chambers 46 defined by insulative conductor supports 34. Thus, portions 44 of first insulative material 28 can be removed or etched in this presently described fabrication method without provision of openings 42**.

In the embodiment illustrated in FIG. 14, a blanket conductive layer is initially formed over segment **22*a* and subsequently patterned into the illustrated conductive layer 40*a*. Layer 40*a* is formed using photolithography in one fabrication method. In one configuration, conductive layer 40*a* is patterned to comprise conductive emitter gate lines over insulative conductor supports 34. In at least one embodiment, etching or removal of portions 44 of first material 28 is subsequent to the patterning which forms conductive layer emitter gate line 40***a*.

Referring to FIG. 15, an expanded plan view of segment 22 of the field emission device is illustrated. Segment 22 includes a plurality of emitter tip arrays 60. Individual emitter tip arrays include a plurality of emitters 26. The depicted number of emitters 26 is illustrative and more or less emitters can be provided within a single emitter tip array 60. In the embodiment described herein, plural emitters 26 of segment 22 illustrated in FIG. 12 are provided within a single emitter tip array 60.

Emitter arrays 60 might also be referred to as pixels. In the depicted configuration, conductive rows and columns are utilized to select desired emitter tip arrays or pixels 60. More specifically, conductive layers 40 comprise conductive columns and plural doped portions 41 of substrate 25 comprise conductive rows.

In the described embodiment, conductive layers 40 individually comprise patterned conductive layers. Conductive columns 40 are held up or supported by insulative conductor supports 34 (not shown in FIG. 15). Conductive layers 40 comprise gate conductors for individual emitters 26.

Portions 41 of substrate 25 are doped to provide n+regions in the described embodiment. Active doped portions 41 of substrate 25 are electrically coupled with emitters 26.

Responsive to selection via external driving circuitry (not illustrated), emitter tip arrays 60 are activated by providing a corresponding voltage potential intermediate a conductive column comprising conductive layer 40 and a conductive row comprising a doped substrate portion 41. Void spaces 46 reduce capacitance between layer 40 and doped portions 41

Figure 16:
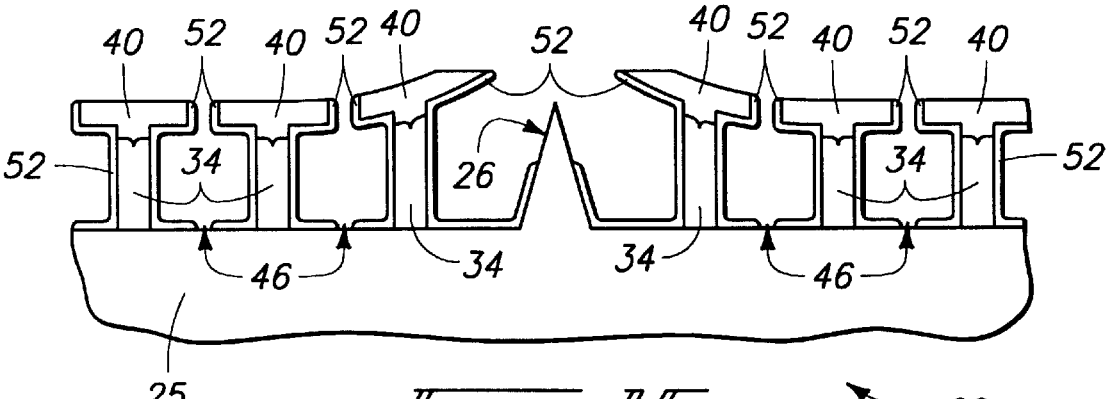
FIG. 16 is a cross-sectional view of the segment shown in FIG. 12 at an optional subsequent processing step.
Figure 11A:
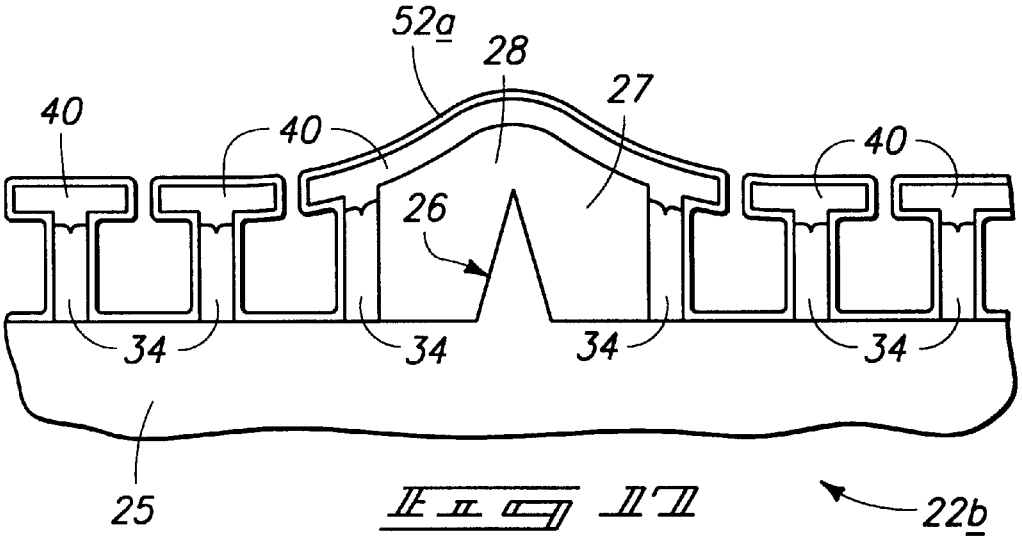
Figure 11B:
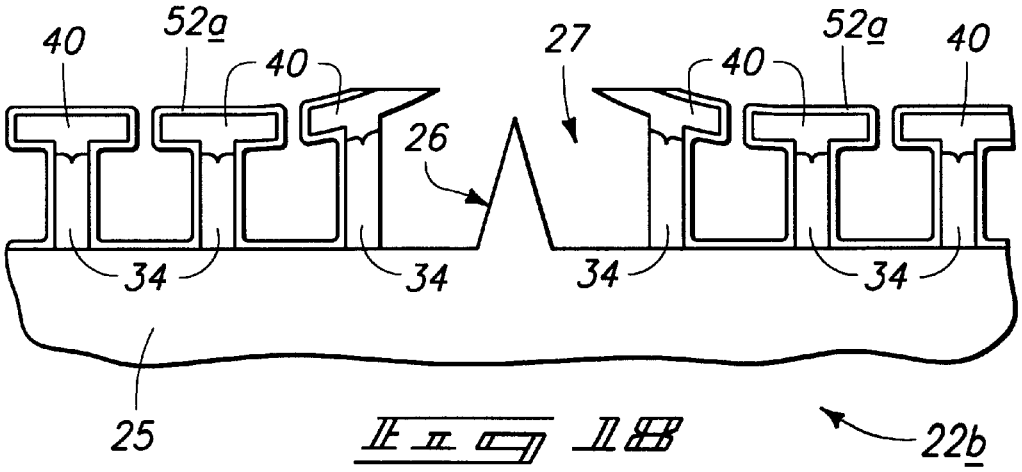

Referring to FIG. 16, a supplemental dielectric layer 52 is illustrated. Supplemental dielectric layer 52 minimizes conduction intermediate substrate 25 and conductor 40 over the surfaces of insulative conductor supports 34. Supplemental dielectric layer 52 is formed within vacuum chambers 46 and upon substrate 25, conductive layer 40 and adjacent insulative conductor supports 34 in the described embodiment. Exemplary materials for supplemental dielectric layer 52 comprise BPSG, tetraethylorthosilicate (TEOS), or phosphosilicate glass (PSG). Supplemental dielectric layer 52 is preferably formed following the removal of first material portions 44 and formation of chambers 46. Following provision of the supplemental dielectric material, blanket etching can occur to remove portions of supplemental dielectric layer 52 over conductor 40.

Referring to FIG. 17 and FIG. 18, an alternative processing method of a field emission device is illustrated. More specifically, formation of an alternative supplemental dielectric layer 52*a* upon another segment 22*b* configuration is described. In particular, dielectric layer 52*a* is formed prior to removal of a corresponding portion of conductive layer 40 over emitter 26 as shown in FIG. 17. The portion of conductive layer 40 over emitter 26 prevents the dielectric material comprising supplemental dielectric layer 52*a* from being formed within emitter cavity 27 about emitter 26. According to the described embodiment, photoresist (not shown) is thereafter provided within vacuum chambers or void spaces 46 of the field emission display to protect dielectric layer 52*a* from subsequent processing steps.

Referring to FIG. 18, a chemical-mechanical polishing process is utilized to remove a portion of conductive layer 40 above emitter 26. The previously deposited photoresist is utilized to protect supplemental dielectric layer 52*a* from exposure to chemicals used during the polishing. The chemical-mechanical polishing of conductive layer 40 above emitter 26 exposes the tip of emitter 26. Following such exposure of emitter 26, a tip cavity etch is performed using an exemplary chemistry of hydrofluoric acid (HF) to remove first material 28 within emitter cavity 27. Subsequently, the protective photoresist is stripped providing the structure illustrated in FIG. 18. Portions of supplemental dielectric layer 52*a* over conductor 40 can be etched in optional process steps.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A field emission device comprising:

a substrate;

at least two adjacent and spaced emitters extending from the substrate;

a conductor spaced from the substrate and configured to receive an electrical charge to control the emission of electrons from the at least two adjacent and spaced emitters; and a plurality of spaced insulative conductor supports positioned between the conductor and the substrate, and intermediate the at least two adjacent and spaced emitters, the insulative conductor supports being spaced at substantially equal distances from one another at positions along a straight line intermediate the emitters.

2. The field emission device according to claim 1 wherein the insulative conductor supports define at least three void spaces intermediate the at least two adjacent and spaced emitters.

3. The field emission device according to claim 2 wherein a vacuum is provided within the at least three void spaces.

4. The field emission device according to claim 1 further comprising a supplemental dielectric layer formed upon the insulative conductor supports, conductor and substrate.

5. The field emission device according to claim 1 wherein the substrate comprises a conductive row and the conductor comprises a conductive column of a field emission display.

6. The field emission device according to claim 1 wherein the at least two adjacent and spaced emitters are within a single emitter tip array.

7. The field emission device according to claim 1 wherein the spaced insulative supports comprise one of polygons and circles.

8. A field emission device comprising:

a substrate;

at least two adjacent and spaced emitters extending from the substrate;

a conductor spaced from the substrate and extending between the at least two spaced emitters, the conductor being configured to receive an electrical charge to control the emission of electrons from the at least two spaced emitters, the conductor and the substrate defining a volume therebetween and along the conductor between the two emitters and having a void space comprising substantially the entire volume; and a plurality of insulative conductor supports intermediate the at least two adjacent and spaced emitters.

9. The field emission device according to claim 8 wherein the volume includes at least three void spaces.

10. The field emission device according to claim 8 wherein the insulative conductor supports extend intermediate the conductor and the substrate.

11. The field emission device according to claim 8 wherein the substrate comprises a conductive row and the conductor comprises a conductive column of a field emission display.

12. The field emission device according to claim 8 wherein the at least two adjacent and spaced emitters are within a single emitter tip array.

13. A field emission device comprising:

a substrate;

at least two adjacent and spaced emitters extending from the substrate; and a conductor spaced from the substrate and extending between the at least two adjacent and spaced emitters, the conductor being configured to receive an electrical charge to control the emission of electrons from the at least two adjacent and spaced emitters, the conductor and the substrate defining a volume therebetween and intermediate the at least two adjacent and spaced emitters, the volume including at least two spaced masses of insulative material individually configured to substantially surround one of the emitters.

14. The field emission device according to claim 13 wherein the at least two spaced masses define at least three void spaces.

15. The field emission device according to claim 13 wherein the at least two spaced masses are configured to support the conductor.

16. The field emission device according to claim 13 wherein the at least two spaced masses are positioned along a straight line intermediate the at least two adjacent and spaced emitters.

17. A field emission device comprising:

a substrate;

at least two adjacent emitters extending from the substrate;

a conductor spaced from the substrate and extending substantially the entire distance between the spaced emitters and configured to receive an electrical charge to control the emission of electrons from the at least two adjacent emitters; and a plurality of spaced insulative conductor supports between the substrate and the conductor and positioned to define at least three void spaces intermediate the at least two adjacent emitters.

18. The field emission device according to claim 17 wherein the substrate comprises a conductive row and the conductor comprises a conductive column of a field emission display.

19. A field emission device comprising:

a substrate;

two adjacent emitters extending from the substrate;

a conductor spaced from the substrate and configured to receive an electrical charge to control the emission of electrons from the two adjacent emitters; and two spaced insulative conductor supports positioned intermediate the two adjacent emitters and individually having a supplemental dielectric layer formed upon an outwardly exposed surface.

20. The field emission device according to claim 19 wherein the two spaced insulative conductor supports individually have plural wall faces and are positioned intermediate the two adjacent emitters such that a straight line between the two adjacent emitters passes through four wall faces of the two spaced insulative supports.

21. A method of forming a field emission device comprising:

providing a substrate;

providing at least two adjacent emitters electrically coupled with the substrate;

forming a conductor over the substrate and outwardly of individual ones of the at least two adjacent emitters; and providing plural insulative conductor supports between the conductor and the substrate, and intermediate the at least two adjacent emitters, the insulative conductor supports being spaced at substantially equal distances from one another at positions along a straight line intermediate the emitters.

22. The method according to claim 21 wherein the providing the at least two adjacent emitters comprises forming the at least two adjacent emitters from the substrate.

23. The method according to claim 21 wherein the providing plural insulative conductor supports defines at least three void spaces intermediate the conductor, substrate, and the at least two adjacent emitters.

24. The method according to claim 23 further comprising providing a vacuum within the at least three void spaces.

25. The method according to claim 21 further comprising forming a supplemental dielectric layer upon the substrate, conductor and insulative conductor supports.

26. A method of forming a field emission device comprising:

providing a substrate;

providing at least two adjacent emitters electrically coupled with the substrate;

forming a conductor over the substrate and outwardly of individual ones of the at least two adjacent emitters and extending substantially the entire distance between the at least two adjacent emitters; and forming a plurality of insulative conductor supports intermediate the at least two adjacent emitters to define at least three void spaces between the substrate and the conductor and intermediate the at least two adjacent emitters.

27. The method according to claim 26 further comprising providing a vacuum within the at least three void spaces.

28. The method according to claim 26 wherein the forming the insulative conductor supports comprises forming the insulative conductor supports to extend intermediate the substrate and conductor.

29. The method according to claim 28 further comprising forming a supplemental dielectric layer upon the substrate, conductor and insulative conductor supports.

30. A method of forming a field emission device comprising:

providing a substrate;

providing at least two adjacent emitters electrically coupled with the substrate;

forming a conductor over the substrate and outwardly of individual ones of the at least two emitters, the forming defining a volume intermediate the conductor and the substrate and extending between the at least two adjacent emitters;

providing a void space within substantially the entire portion of the volume; and forming a plurality of insulative conductor supports intermediate the at least two adjacent emitters.

31. The method according to claim 30 wherein the providing the void space comprises forming a plurality of void spaces using the insulative conductor supports.

32. A method of forming a field emission device comprising:

defining adjacent spaced emitter regions on a substrate;

forming a first material as a layer over the substrate;

forming openings into the first material;

providing a second material within the openings, the second material being insulative;

forming a conductive layer over the first and second materials;

after forming the conductive layer, etching the first material; and patterning the conductive layer into conductive emitter gate lines overlying the second material.

33. The method according to claim 32 wherein the forming openings comprises forming openings through the first material to the substrate.

34. The method according to claim 32 wherein the etching is selective to the second material.

35. The method according to claim 32 further comprising forming openings into the conductive layer prior to the etching.

36. The method according to claim 32 wherein the etching is subsequent to the patterning.

37. The method according to claim 32 wherein the etching forms a plurality of void spaces between the conductive layer and the substrate and intermediate the adjacent spaced emitter regions.

38. A method of forming a field emission device comprising:

providing a substrate;

forming an emitter to extend from the substrate;

forming a first layer over the substrate using a first material;

forming at least one opening within the first layer;

providing an insulating material over the first layer and within the at least one opening leaving an insulative support within the at least one opening;

removing portions of the insulating material outside of the at least one opening;

forming a second layer comprising a conductive gate over the first layer and the insulative material; and substantially removing the first layer leaving the insulative support intermediate the gate and the substrate.

39. The method according to claim 38 wherein the forming the second layer comprises forming a patterned conductive layer.

40. The method according to claim 38 further comprising forming a plurality of openings within the conductive layer before the removing the first layer.

41. The method according to claim 38 wherein the removing the first layer forms a plurality of insulative supports intermediate the gate and the substrate.

42. The method according to claim 38 wherein the removing the first layer forms a plurality of void spaces intermediate the substrate and the conductive layer.

43. A method of forming a field emission display comprising:

providing a substrate;

forming a plurality of emitters to extend from the substrate;

forming a first insulative layer over the substrate and the emitters;

removing selected portions of the first insulative layer to form a plurality of first openings;

forming a second insulative layer comprising a dielectric material over the first insulative layer;

forming a plurality of adjacent insulative conductor supports comprising the dielectric material within the first openings;

removing the second insulative layer formed over the first insulative layer;

forming a conductive layer over the first insulative layer and the adjacent insulative conductor supports following the removing the second insulative layer;

removing portions of the conductive layer corresponding to the emitters;

providing a plurality of second openings within the conductive layer, the second openings exposing corresponding portions of the first insulative layer below the respective second openings and intermediate adjacent insulative conductor supports;

removing portions of the first-insulative layer providing a plurality of vacuum chambers defined by the substrate, conductive layer and adjacent insulative conductor supports; and forming a supplemental dielectric layer within the vacuum chambers and upon the substrate, conductive layer and adjacent insulative conductor supports.

* * * * *